US005876186A

United States Patent [19]

Stiefel

[11] Patent Number: 5,876,186

[45] Date of Patent: Mar. 2, 1999

[54] HIGH PRESSURE PUMP FOR A FUEL INJECTION DEVICE

[75] Inventor: Hans-Peter Stiefel, Ditzingen, Germany

[73] Assignee: Robert Bosch GmbH, Stuttgart, Germany

[21] Appl. No.: 670,884

[22] Filed: Jun. 26, 1996

[30] Foreign Application Priority Data

Jun. 27, 1995 [DE] Germany ..... 195 23 283.6

[51] Int. Cl.[6] ..... F04B 1/053

[52] U.S. Cl. ..... 417/273

[58] Field of Search ..... 417/269, 273, 417/554, 266; 91/474, 477, 476, 490, 491, 226, 228, 234; 123/495; 137/454.2, 454.4, 454.5, 454.6; 251/315.14

[56] References Cited

U.S. PATENT DOCUMENTS

| | | | |
|---|---|---|---|
| Re. 32,373 | 3/1987 | Bobier . | |
| 2,040,390 | 5/1936 | Loe . | |
| 2,657,634 | 11/1953 | Greenland et al. | 91/474 X |
| 3,486,454 | 12/1969 | Tuzson . | |
| 3,682,572 | 8/1972 | Yarger | 417/273 |
| 3,759,637 | 9/1973 | Vuaille | 123/495 X |
| 5,071,324 | 12/1991 | Ishimoto | 123/495 X |
| 5,213,482 | 5/1993 | Reinartz et al. | 417/273 |

FOREIGN PATENT DOCUMENTS

| | | | |
|---|---|---|---|
| 0095992 | 12/1983 | European Pat. Off. . | |
| 0254579 | 1/1988 | European Pat. Off. . | |
| 3308507 | 9/1986 | Germany . | |
| 4318073 | 12/1993 | Germany | 417/273 |

*Primary Examiner*—Ismael Izaguirre
*Attorney, Agent, or Firm*—Edwin E. Greigg; Ronald E. Greigg

[57] ABSTRACT

A high pressure pump for a fuel injection device of an internal combustion engine, having a housing, which has an inflow region and a delivery region, having at least one piston, and having a drive element which act upon the piston. The piston is movably disposed in a piston guide of a pump cylinder element and establishes a work chamber in the piston guide which is operatively provided between the inflow region and the delivery region, which chamber, depending upon the movement direction of the piston, can alternatingly communicate with the inflow region and the delivery region. In order to reduce the assembly and handling expenditure for the assembly and to thus cut corresponding assembly costs, it is provided that the pump cylinder element together with a valve which is provided between the work chamber and the delivery region, is fixed in a retaining element which is fastened to the housing.

24 Claims, 3 Drawing Sheets

HIGH PRESSURE PUMP FOR A FUEL INJECTION DEVICE

BACKGROUND OF THE INVENTION

The invention relates to a pump for a fuel injection device of an internal combustion engine.

A known pump of this kind, (H. Ebertshauser, "Fluidtechnik von A–Z" ["Fluid Technology from A to Z"], 1989, Vereinigte Fachverlage, Mainz, p. 339), which is embodied as a swash plate pump, has a cylinder block in a housing, with a plurality of cylinder bores in which the individual pistons are movably disposed. The cylinder block is associated with a valve plate, which is connected to a housing cover part, which has the individual pump connections. The housing, the cylinder block, the valve plate, and the housing cover part are secured to one another.

In another pump of this generic type (loc. cit., p 295f), which is embodied as a swash plate pump, the cylinder block with the individual pump cylinders is embodied as a rotating drum, which is associated with a valve plate which has the individual valves.

Pumps of this kind have the disadvantage that the individual components are relatively difficult to produce and costly to assemble.

OBJECT AND SUMMARY OF THE INVENTION

The pump according to the invention has the advantage over the prior art that the pump cylinder element, along with the associated valve, which is oriented toward the delivery side, is built into a retaining element and is connected to this element in a pressure-tight manner. The pump cylinder element, together with the valve and the retaining element, constitutes a pump element, which can be manufactured as a pre-assembled part, completed with other components, and then installed in the housing of the pump as a single structural unit. By means of this, the assembly and handling expenditure is reduced so that corresponding assembly costs can be reduced.

Advantageous further developments of and improvements of the pump are possible by means of the provisions recited hereinafter.

It is particularly advantageous that the pump element can be metallically sealed toward the outside without requiring tolerance compensating disks, which require a corresponding measurement technology. In particular, when using the pump according to the invention as a gasoline pump, the metallic seal is advantageous in comparison to a seal with elastomer parts because the metallic seal is not sensitive to gasoline and assures the required tightness of the pump, even at low temperatures and high pressures.

A further advantage is comprised in that the pump element of the pump according to the invention can be used unchanged in axial piston pumps as well as in radial and in-line piston pumps. It is particularly useful that the piston guide for the piston in the relatively small pump cylinder element can be embodied as a through bore so that the pump cylinder element can be easily produced.

Furthermore, it is particularly advantageous that the most suitable respective material can be selected for the individual parts of the pump, since the pump cylinder elements, the valve plates of the valves, which are embodied in particular as pressure valves, and the retaining element are embodied as individual parts which are separate from one another so that the individual elements of the pump can be embodied of the respective materials most suitable for them.

In a further embodiment of the invention, a plurality of pump cylinder elements is disposed in a common retaining element, which produces a further simplification of the assembly.

The invention will be better understood and further objects and advantages thereof will become more apparent from the ensuing detailed description of preferred embodiments taken in conjunction with the drawings.

DETAILED DESCRIPTION OF THE PREFERRED EMBODIMENTS

Figure 1:
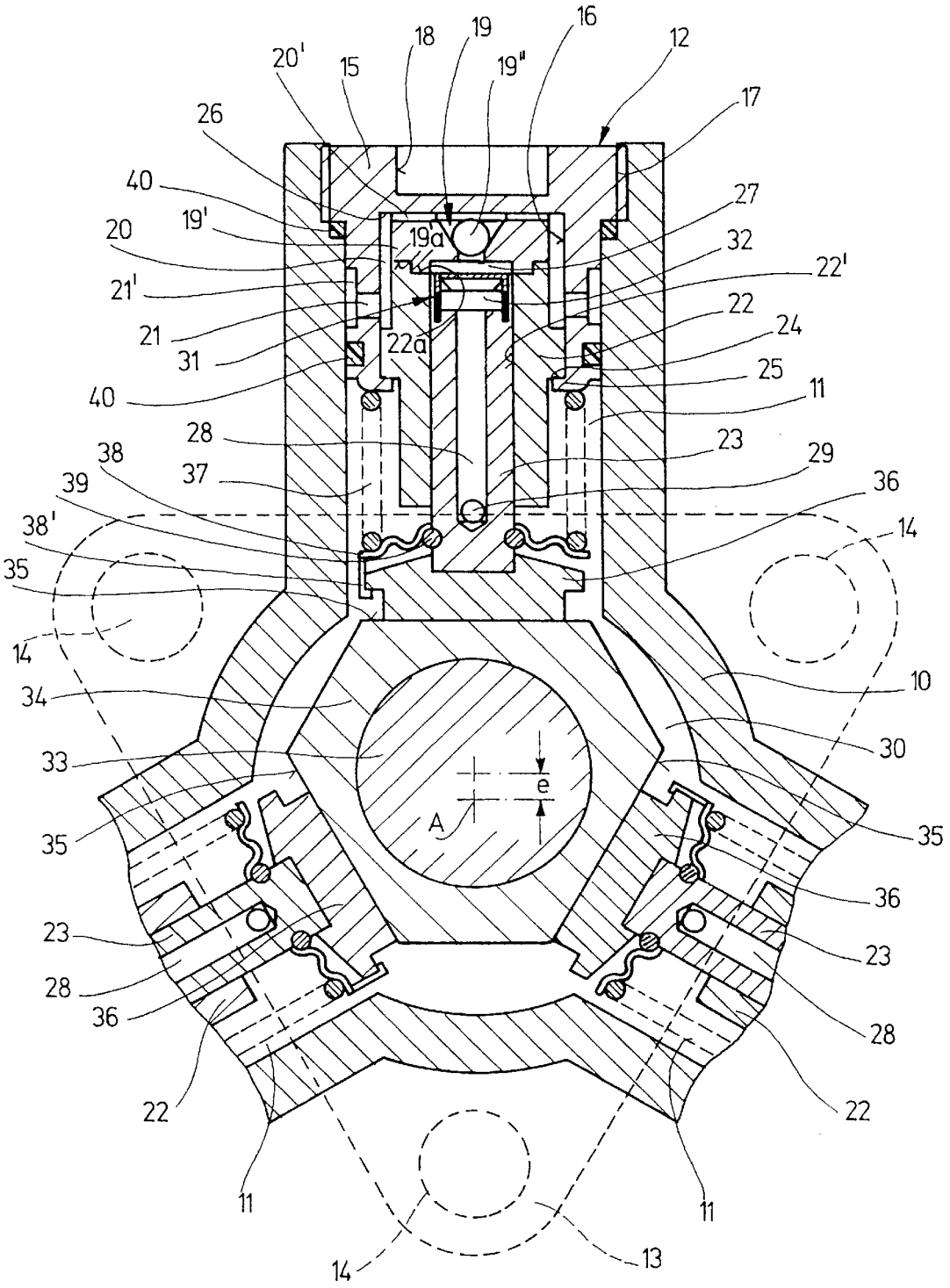
FIG. 1 shows a schematic section through a pump according to the invention, which is embodied as a radial piston pump.

In the various drawing figures, parts which correspond to one another are provided with the same reference numerals.

The pump shown in FIG. 1, which is particularly suitable as a high pressure pump for a fuel injection device, has three chambers 11, which are disposed in a star shape in a housing 10 and are each for containing a pump element 12, of which only one is completely shown in FIG. 1. The pump is used to deliver a pressure medium, for example a fluid, in particular fuel, especially gasoline.

A fastening flange 13, which is shown with dashed lines, is provided on the housing 10, with bores 14 for fastening the pump to a corresponding carrier element.

Each pump element 12 includes a retaining element 15, which is embodied for example as a screw fitting, with a blind bore 16, which is used as a receiving chamber, an external thread 17, and an engaging opening 18 for a screw driver. A valve 19 with a valve plate 19', which has a valve opening, and an associated valve ball 19", as well as a pump cylinder element 22 with a guide or cylinder bore 22' for a piston 23 are inserted into the blind bore 16, wherein the piston 23 is disposed so that it can move in the guide or cylinder bore 22'. The guide or cylinder bore 22' is preferably embodied as a through bore, but could also be embodied as a blind hole with a corresponding outlet.

The valve 19, which is preferably embodied as a pressure valve, is disposed between a work chamber 27, which is established in the cylinder chamber of the pump cylinder element 22 by the piston 23, and a delivery or high pressure region 20 in the retaining element 15. With a sealing face 19'*a* provided on the valve plate 19', the valve 19 rests against an end face 22*a* of the pump cylinder element 22, which end face is embodied as a corresponding sealing face.

The high pressure region 20 communicates via delivery openings 21 and an annular conduit 21' with a corresponding high pressure connection (not shown) in the housing 10. An opening 20' is provided in the valve plate 19'. The high pressure region 20 extends from the valve 19, through the opening 20', the delivery openings 21, and the annular conduit 21', into the high pressure connection, not shown in FIGS. 1 and 2.

A shoulder 24 is provided on the outer circumference of the pump cylinder element 22, against which a flange 25, which is provided on the retaining element 15 is crimped, so that the pump cylinder element 22 presses the valve plate 19' against a bottom 26 of the blind bore 16 so that the pump cylinder element 22 rests in a pressure-tight manner against the valve plate 19' and the crimped flange 25 rests in a pressure-tight manner against the shoulder 24.

The piston 23 disposed in the pump cylinder element 22 has an inflow conduit 28 extending in the axial direction of the piston 23, which conduit, on its end remote from the work chamber 27, communicates via a lateral bore 29 with an inflow or low pressure region 30 provided in the housing 10.

The piston 23 is associated with an inflow valve 31 which has a valve plate 32, which opens or closes the mouth of the inflow conduit 28 into the work chamber 27, depending upon the movement of the piston 23.

A crankshaft 33 is provided to set the piston 23 in an oscillating pumping motion; an eccentric rotor 34 with slide faces 35 is disposed on the cranking section of this crankshaft. On the piston 23, a guide shoe 36 is provided, which is secured in contact with the corresponding slide face 35 by springs 37. The springs 37 are supported on the crimped flange 25 and on a spring plate 38, which is attached to the piston 23 with a securing ring 39.

The valve 19 permits a flow of the pressure medium from the work chamber 27 into the high pressure region 20 and prevents a return flow of the pressure medium from the high pressure region 20 into the work chamber 27.

When the crankshaft 33 is rotated around its rotational axis A, the eccentric rotor 34 on the crank section executes an eccentric rotational movement around the rotational axis A of the crankshaft 33, since the center point of the crank section is offset by the distance e in relation to the rotational axis A of the crankshaft 33.

The pump element 12 of the pump according to the invention is assembled in the following manner.

First, the valve plate 19 with the valve ball 19' is inserted into the blind bore 16. Then, the pump cylinder element 22 is inserted so that the end face 22*a* of the pump cylinder element 22 rests against the sealing face 19'*a* of the valve plate 19'. Now, the crimping edge or flange 25 is crimped so that the pump cylinder element 22 is flanged in a pressure-tight manner to both the valve plate 19' and the securing element 15. Then, the piston 23 with the inflow valve 31 is inserted and the spring 37 is fixed together with the spring plate 38 and secured to the piston 23 with the securing ring 39. The pump element 12 is completed by attaching the guide shoe 36 and by sealing rings 40, and is completed as a pre-assembled part.

A bracket 38' is formed onto the spring plate 38 and is bent so that it overlaps a step of the guide shoe 36 and as a result, secures the guide shoe 36 on the piston 23. This makes the handling of the pump element 12 as a pre-assembled part essentially easier.

After this, the pump element 12 can be simply inserted into the corresponding chamber 11 in the housing 10 and fastened.

The assembly of the pump according to the invention can be simplified by embodying the pump element 12 according to the invention as a preassembled part, as a result of which assembly costs can be reduced.

In particular, the sealing of the individual components of the pump element is executed in a simple way with metallic seals.

Figure 2:
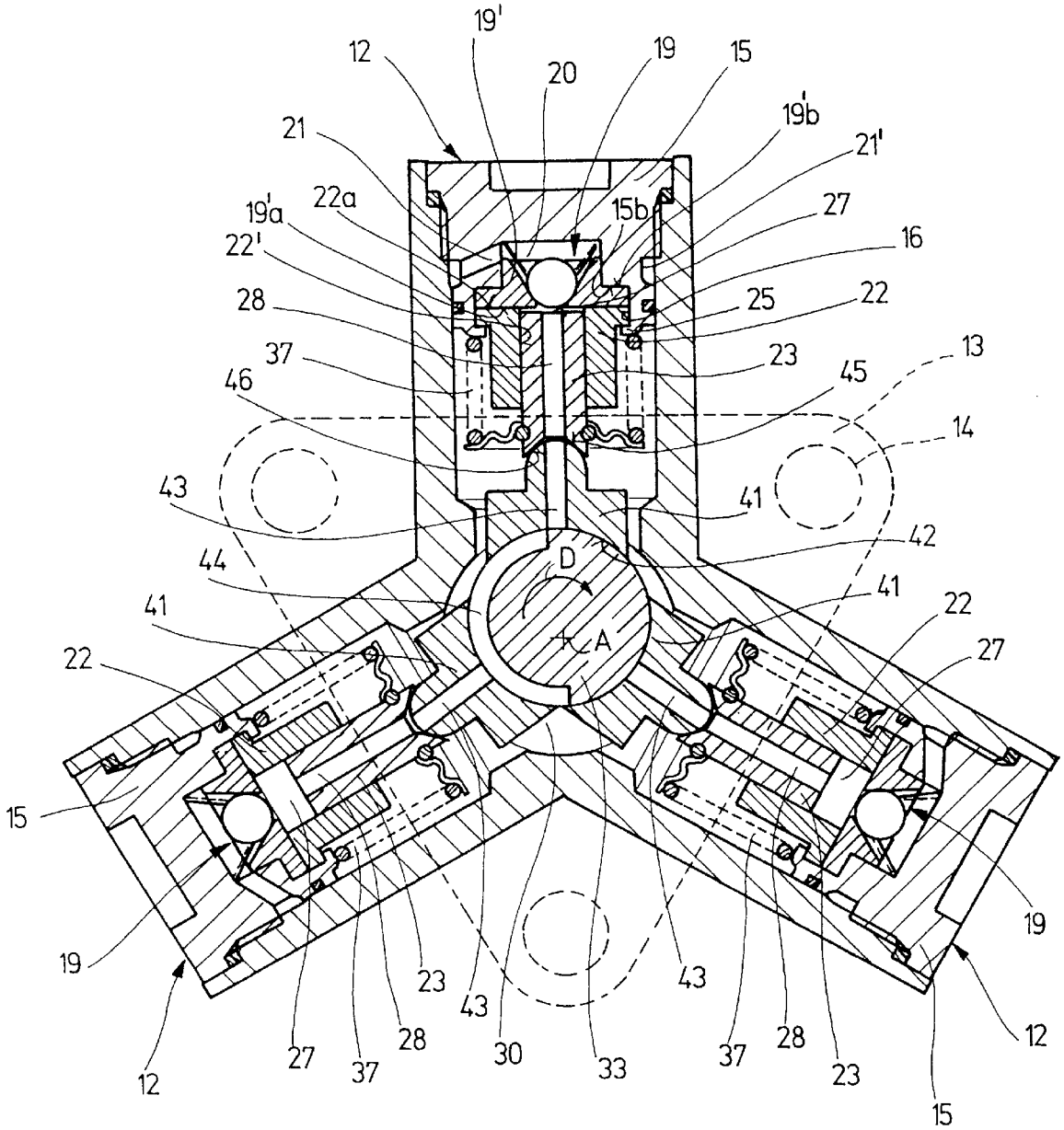
FIG. 2 shows a schematic section through a radial piston pump according to another exemplary embodiment of the invention.

The pump shown in FIG. 2 corresponds to a large extent with the one described in conjunction with FIG. 1 and essentially differs only by means of the embodiment of the inflow valve, the guide shoes, and the crank section of the crankshaft, as well as the sealing of the valve 10 and pump cylinder element 22 associated with the delivery side. In the following, therefore, only the components which essentially deviate from the embodiment of the pump according to FIG. 1 are described.

The radial piston pump according to FIG. 2 has guide shoes 41 associated with the pistons 23, which shoes rest with a circular, cylindrical sealing face is 42 directly against a crank section of the crankshaft 33 and are provided with an inflow conduit 43. The crank section of the crankshaft 33 has a groove 44, which extends around half of the circumference of the crank section of the crankshaft 33. On their ends remote from the crank section of the crankshaft 33, the guide shoes 41 have a sealing face 45 in the shape of a half-ball, which cooperates with an essentially conical sealing face 46 on the piston 23.

Consequently, the guide shoes 41, together with the crank section of the crankshaft 33 constitute an inflow valve, which is controlled by the crankshaft position and which, as with the pump element 12 shown on the bottom right in FIG. 2, closes the work chamber 27 in the pump cylinder element 22 off from the low pressure region 30 in the pump housing 10 during the compression stroke of the piston 23, until the piston 23 has finished the compression stroke, as shown with the pump element 12 depicted on top in FIG. 2. With a further movement of the crank section of the crankshaft 33 in the direction of arrow D, during the following intake stroke, the work chamber 27 communicates via the inflow conduit 28 in the piston 23, the inflow conduit 43 in the guide shoe 41, and the groove 44, with the inflow or low pressure region 30, as is shown with the pump element 12 depicted on the bottom left in FIG. 2.

As FIG. 2 shows, the valve plate 19' of the valve 19 has another sealing face 19'*b*, with which it is secured in sealing contact with a stop 15*b*, which is used as a sealing face.

In this pump as well, the pump element 12 constitutes a pre-assembled part, which, except for the described differences, corresponds to the pump element 12 described in conjunction with FIG. 1, in particular in the embodiment of the guide shoe 41 and the inflow valve.

The pump element 12 embodied according to the invention can be employed not only in radial piston pumps as shown in conjunction with FIGS. 1 and 2, but in the same manner, for example, even with axial and in-line pumps, as well as with oblique axis pumps.

Figure 3:
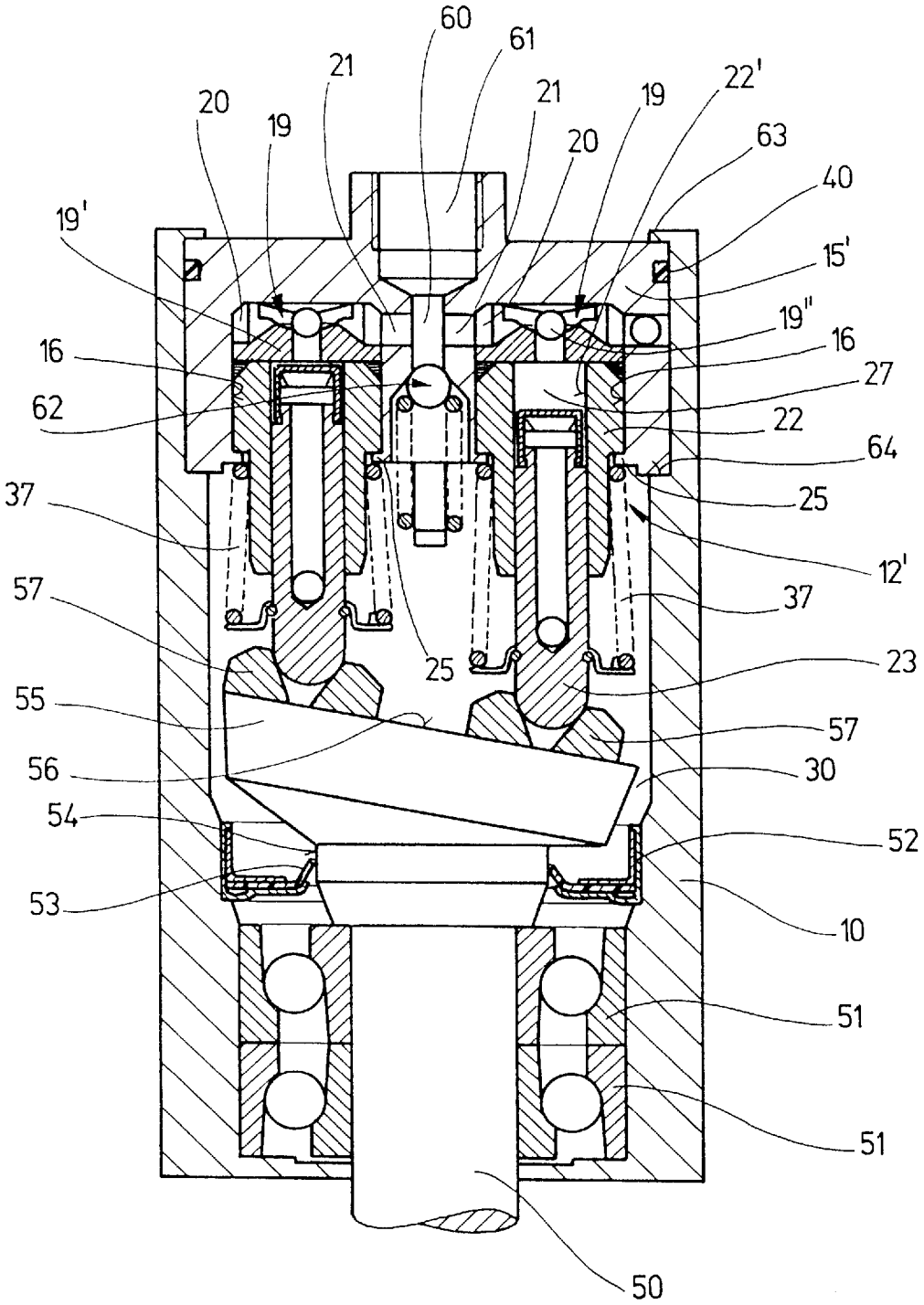
FIG. 3 shows a schematic section through another pump according to the invention, which is embodied as an axial piston pump.

FIG. 3 shows an axial piston pump with a housing 10, in which a drive shaft 50 is rotatably supported by rolling bearings 51. In order to seal the low pressure region 30 in the housing 10 in relation to the bearing region of the drive shaft 50, a sealing element 52 is provided, which rests with a sealing lip 53 against a sealing face 54 of the drive shaft 50. On its end which protrudes into the low pressure region 30, the drive shaft 50 carries a swash plate 55; guide shoes 57 for the pistons 23 of the individual pump elements 12' are disposed upon the obliquely set slide face 56 of this swash plate 55. A retaining element 15' is inserted into the housing 10, which element has a plurality of blind bores 16; a valve 19 with a valve plate 19' and an associated valve ball 191, as well as a pump cylinder element 22 with a piston 23 disposed in it, are received in each of these blind bores 16. The valve plate 19' is crimped in a pressure-tight manner into the respective blind bore 16 together with the pump cylinder element 22.

The delivery of high pressure regions 20 constituted in the blind bores 16 communicate via laterally extending delivery openings 21 with a delivery or pressure conduit 60 which runs parallel to the longitudinal direction of the piston and, with its end remote from the low pressure region 30 in the housing 10, communicates with a delivery or high pressure connection 61 on the retaining element 15'. The end of the pressure conduit 60 oriented toward the low pressure region 30 is closed by an overpressure valve 62.

In the exemplary embodiment of the present invention shown in FIG. 3, the pre-assembled part includes a retaining element 15' in which a plurality of pump cylinder elements 22, with associated valves 19 and pistons 23, are inserted.

The assembly of the pre-assembled part is carried out in a corresponding manner, as with the pre-assembled part described in conjunction with FIG. 1. The completed component which is provided with a seal 40 on the outer circumference of the retaining element 15', is inserted with the preassembled part into the housing 10; the retaining element 15' is pressed by means of a crimped flange 63 in a pressure-tight manner against a stop shoulder 64, which acts as a further seal, in order to secure the pre-assembled part, which contains the pump elements 12, in the housing 10.

The crimped flange 63, with which the retaining element 15' is secured in the housing 10, suitably does not extend around the entire circumference of the receiving opening for the retaining element 15', but is embodied only in individual sections of the circumference.

Correspondingly, the pump cylinder elements 22 are also not necessarily secured in the blind bores 16 by a flange 25 which runs completely around them, but instead are secured only at individual sections of their circumference.

In the exemplary embodiments shown in FIGS. 1 and 2, the retaining element 15 is screwed into the housing 10. In the exemplary embodiment according to FIG. 3, the retaining element 15' is crimped into the housing 10. It should be noted that the retaining element 15' shown in FIG. 3 can also be provided with an external thread with which it can be screwed into an internal thread (not shown) provided in the housing 10. Then the crimping is unnecessary.

The exemplary embodiments shown in FIGS. 1 and 2 can also be modified, for example by the retaining element being crimped in instead of being screwed in.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A high pressure pump for a fuel injection device of an internal combustion engine, comprising a housing (10), which has an inflow region (30) and a delivery region (20), at least one piston (23), which is movably disposed in a piston guide of a pump cylinder element (22) and establishes a work chamber (27) in said pump cylinder element which is operatively provided between the inflow region (30) and the delivery region (20), wherein depending upon a movement direction of the at least one piston (23), the work chamber (27) alternatingly communicates with the inflow region (30) and the delivery region (20), and drive means (33, 34; 50, 55) which act upon the at least one piston (23), a valve (19), said valve (19) is provided between the work chamber (27) and the delivery region (20) and is fixed in a retaining element (15, 15'), which is embodied in one piece and fastened to the housing (10), and the pump cylinder element is attached directly to the retaining element (15, 15').

2. The pump according to claim 1, in which the retaining element (15, 15') has at least one receiving chamber (16) for said pump cylinder element (22) and the valve (19) is associated with the delivery region.

3. The pump according to claim 2, in which the retaining element (15') has at least three receiving chambers (16), each for said pump cylinder element (22), and the valve (19) is associated with the delivery region.

4. The pump according to claim 2, wherein at least one receiving chamber (16) is embodied as a blind bore into which the valve (19), which is associated with the delivery region (20), and the pump cylinder element (22) are inserted so that the delivery region (20) is divided from the work chamber (27) in a pressure-tight manner, wherein a delivery opening (21) is provided in the retaining element (15, 15'), and via said delivery opening the delivery region constituted in the blind bore (16) communicates with a delivery connection (61).

5. The pump according to claim 4, in which the pump cylinder element (22) has a shoulder (24) which runs around an outer circumference, against which a crimping edge or flange (25) on the retaining element (15, 15') is crimped.

6. The pump according to claim 4, in which the valve (19), which is provided between the work chamber (27) and the delivery region (20), has a valve plate (19') which rests with a sealing face **(19'*a*) against an end face (22*a*) of the pump cylinder element (22), said end face is likewise embodied as a sealing face and is clamped between the pump cylinder element (22) and a stop in the retaining element (15, 15')**.

7. The pump according to claim 2, in which the pump cylinder element (22) has a shoulder (24) which runs around an outer circumference, against which a crimping edge or flange (25) on the retaining element (15, 15') is crimped.

8. The pump according to claim 2, in which the valve (19), which is provided between the work chamber (27) and the delivery region (20), has a valve plate (19') which rests with a sealing face **(19'*a*) against an end face (22*a*) of the pump cylinder element (22), said end face is likewise embodied as a sealing face and is clamped between the pump cylinder element (22) and a stop in the retaining element (15, 15')**.

9. The pump according to claim 1, in which a delivery connection (61) is provided on the retaining element (15').

10. The pump according to claim 9, in which the pump cylinder element (22) has a shoulder (24) which runs around an outer circumference, against which a crimping edge or flange (25) on the retaining element (15, 15') is crimped.

11. The pump according to claim 9, in which the valve. (19), which is provided between the work chamber (27) and the delivery region (20), has a valve plate (19') which rests with a sealing face **(19'*a*) against an end face (22*a*) of the pump cylinder element (22), said end face is likewise embodied as a sealing face and is clamped between the pump cylinder element (22) and a stop in the retaining element (15, 15')**.

12. The pump according to claim 1, in which the retaining element (15) is embodied as a screw fitting.

13. According to claim 12, in which the pump cylinder element (22) has a shoulder (24) which runs around an outer circumference, against which a crimping edge or flange (25) on the retaining element (15, 15') is crimped.

14. The pump according to claim 12, in which the valve (19), which is provided between the work chamber (27) and the delivery region (20), has a valve plate (19') which rests with a sealing face **(19'*a*) against an end face (22*a*) of the pump cylinder element (22), said end face is likewise embodied as a sealing face and is clamped between the pump cylinder element (22) and a stop in the retaining element (15, 15')**.

15. The pump according to claim 1, in which the pump cylinder element (22) has a shoulder (24) which runs around an outer circumference, against which a crimping edge or flange (25) on the retaining element (15, 15') is crimped.

16. The pump according to claim 15, in which the valve (19), which is provided between the work chamber (27) and the delivery region (20), has a valve plate (19') which rests with a sealing face (19'*a*) against an end face (22*a*) of the pump cylinder element (22), said end face is likewise embodied as a sealing face and is clamped between the pump cylinder element (22) and a stop in the retaining element (15, 15').

17. The pump according to claim 1, in which the valve (19), which is provided between the work chamber (27) and the delivery region (20), has a valve plate (19') which rests with a sealing face (19'*a*) against an end face (22*a*) of the pump cylinder element (22), said end face is likewise embodied as a sealing face and is clamped between the pump cylinder element (22) and a stop in the retaining element (15, 15').

18. The pump according to claim 17, in which an annular sealing face (15*b*), against which the valve plate (19') of the valve (19) is pressed with a correspondingly annular sealing face (19'*b*), is provided as a stop for the valve (19).

19. The pump according to claim 1, in which the piston guide (22') for the piston (23) in the pump cylinder element (22) is embodied as a through bore.

20. A high pressure pump for a fuel injection device of an internal combustion engine, comprising a housing (10), which has an inflow region (30) and a delivery region (20), at least one piston (23), which is movably disposed in a piston guide of a pump cylinder element (22) and establishes a work chamber (27) in said pump cylinder element which is operatively provided between the inflow region (30) and the delivery region (20), wherein depending upon a movement direction of the piston (23), the work chamber (27) alternatingly communicates with the inflow region (30) and the delivery region (20), drive means (33, 34; 50, 55) which act upon the piston (23), the pump cylinder element (22), together with a valve (19), which is associated with the delivery region, said valve (19) is provided between the work chamber (27) and the delivery region (20) and is fixed in a retaining element (15, 15'), which is fastened to the housing (10), and the retaining element (15') has at least three receiving chambers (16), each for a pump cylinder element (22).

21. The pump according to claim 20, wherein each receiving chamber (16) is embodied as a blind bore into which the valve (19), which is associated with the delivery region (20), and the pump cylinder element (22) are inserted so that the delivery region (20) is divided from the work chamber (27) in a pressure-tight manner, wherein a delivery opening (21) is provided in the retaining element (15, 15'), and via said delivery opening the delivery region constituted in the blind bore (16) communicates with a delivery connection (61).

22. The pump according to claim 20, in which the pump cylinder element (22) has a shoulder (24) which runs around an outer circumference, against which a crimping edge or flange (25) on the retaining element (15, 15') is crimped.

23. The pump according to claim 20, in which the valve (19), which is provided between the work chamber (27) and the delivery region (20), has a valve plate (19') which rests with a sealing face (19'*a*) against an end face (22*a*) of the pump cylinder element (22), said end face is likewise embodied as a sealing face and which is clamped between the pump cylinder element (22) and a stop in the retaining element (15, 15').

24. A high pressure pump for a fuel injection device of an internal combustion engine, comprising a housing (10), which has an inflow region (30) and a delivery region (20), at least one piston (23), which is movably disposed in a piston guide of a pump cylinder element (22) and establishes a work chamber (27) in said pump cylinder element which is operatively provided between the inflow region (30) and the delivery region (20), wherein depending upon a movement direction of the piston (23), the work chamber (27) alternatingly communicates with the inflow region (30) and the delivery region (20), and drive means (33, 34; 50, 55) which drives the piston (23), the pump cylinder element (22), together with a valve (19), said valve (19) is provided between the work chamber (27) and the delivery region (20) and is fixed in a retaining element (15, 15'), which is fastened to the housing (10) said drive means includes a crankshaft (33), which is rotatable about a pivot axis (A).and is provided with a crank portion offset from the pivot axis (A) of the crankshaft (33), an eccentric rotor (34) that executes an eccentric revolving motion about the pivot axis (A) of the crankshaft (33) is rotatably supported on said crank portion, and the piston (23) is supported on a sliding face (35) provided on the eccentric rotor (34).

* * * * *